US007201607B2

(12) United States Patent
Bernhart et al.

(10) Patent No.: US 7,201,607 B2
(45) Date of Patent: Apr. 10, 2007

(54) STACKABLE MODULAR GENERAL PURPOSE RECTANGULAR CONNECTOR

(75) Inventors: William Henry Bernhart, Monroe, WA (US); Brent David Yohn, Newport, PA (US); John A. Fulponi, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/064,584

(22) Filed: Feb. 24, 2005

(65) Prior Publication Data

US 2006/0189185 A1 Aug. 24, 2006

(51) Int. Cl.
*H01R 13/60* (2006.01)

(52) U.S. Cl. ..... 439/532; 439/540.1

(58) Field of Classification Search ..... 439/532 I, 439/540.1 X, 545, 701, 532, 540.1
See application file for complete search history.

(56) References Cited

U.S. PATENT DOCUMENTS

| | | | | |
|---|---|---|---|---|
| 4,343,528 A | | 8/1982 | Lucius et al. | |
| 4,596,436 A | | 6/1986 | Kraemer et al. | |
| 4,972,298 A | * | 11/1990 | Casa et al. | 361/686 |
| 5,190,480 A | | 3/1993 | Chau et al. | |
| 5,326,279 A | * | 7/1994 | Sumida | 439/540.1 |
| 5,356,315 A | | 10/1994 | Jankowski et al. | |
| 5,584,728 A | | 12/1996 | Cheng | |
| 5,725,397 A | * | 3/1998 | Fukamachi et al. | 439/701 |
| 5,836,786 A | | 11/1998 | Pepe | |
| 5,893,763 A | * | 4/1999 | O'Connor et al. | 439/76.1 |
| 5,980,312 A | * | 11/1999 | Chapman et al. | 439/540.1 |
| 6,086,415 A | * | 7/2000 | Sanchez et al. | 439/540.1 |
| 6,123,554 A | | 9/2000 | Ortega et al. | |
| 6,537,106 B1 | | 3/2003 | Follingstad | |
| 6,767,241 B1 | * | 7/2004 | Abel et al. | 439/417 |

FOREIGN PATENT DOCUMENTS

| | | |
|---|---|---|
| DE | 1 590 585 | 5/1970 |
| EP | O 901 197 A2 | 10/1999 |

OTHER PUBLICATIONS

European Patent Office Search Report for Counterpart Application, EP 06110355.2-2214.

* cited by examiner

*Primary Examiner*—Thanh-Tam Le

(57) ABSTRACT

A stackable modular connector assembly, is provided. The stackable modular connector assembly includes a track having a pair of juxtaposed rails each defining an elongate channel formed therein. Desirably, the channels are oriented toward one another. The stackable modular connector assembly further includes a plurality of connector shells operatively engageable with the track. Desirably, each connector shell extends between the opposed channels of the pair of rails and is slidably stackable within the channels of the track.

13 Claims, 4 Drawing Sheets

STACKABLE MODULAR GENERAL PURPOSE RECTANGULAR CONNECTOR

BACKGROUND

1. Technical Field

The present disclosure relates to electrical interconnection assemblies and, more particularly, to stackable modularized connector assemblies.

2. Background of Related Art

As used in the present disclosure, the term "electrical connector" refers to a housing containing a plurality of electrical contact terminals which is intended to be coupled and/or mated to a complementary electrical connector to form a connector assembly. One type of electrical connector is in the form of a housing assembly including a frame or shell configured and dimensioned to support a connector module.

Connector housing assemblies of the type comprising a frame and modules require a system for removably retaining the individual modules in the frame in a positive manner which nonetheless permits removal of the individual modules for servicing and/or repair.

In accordance with an aspect of the present disclosure, the present invention is directed to an improved module-retaining member for retaining individual connector modules in a housing frame of a connector housing assembly.

In accordance with another aspect of the present disclosure, the invention is directed to a stackable modular general purpose rectangular connector which may be produced via molding and/or die casting to reduce the costs associated with manufacturing the same.

SUMMARY

The present disclosure relates to electrical interconnection assemblies. More particularly, the present disclosure relates to stackable modular connector assemblies.

According to one aspect of the present disclosure, a stackable modular connector assembly, is provided. The connector assembly includes a track having a pair of rails. Each rail includes a channel formed along a length thereof with the channels of each rail being in juxtaposed relation to one another. Connector assembly further includes at least one connector shell supportable by the pair of rails. Each connector shell defines at least one receptacle for selectively receiving a connector. Each connector shell further includes a pair of tabs extending from opposed sides thereof. Each tab is configured and dimensioned for slidable engagement in the channels of the rails. Accordingly, a first rail is disposed along a first side of the connector shell and a second rail is disposed along a second side of the connector shell.

Desirably, each tab of each connector shell includes a hole formed therein. Additionally, each rail includes a pair of apertures formed therein. Preferably, a first aperture is formed near a first end of the rail and a second aperture is formed near a second end of the rail. Accordingly, the holes from each connector are registerable with the corresponding apertures formed in the pair of rails.

It is envisioned that the channel of each rail may extend the entire length thereof. Desirably, each rail may include at least one mounting hole formed therein for securing the rail to a support structure.

It is contemplated that the track may include a web extending between and interconnecting each rail to one another. In one embodiment, the web defines at least one window formed therein. In this embodiment, the web may include an upper backspan and a lower backspan defining the window therein. In another embodiment, the web defines a window for each receptacle of each connector shell positioned between the pair of rails.

Preferably, only an upper-most and a lower-most connector shell are fastened to the pair of rails. It is envisioned that threaded fasteners secure the upper-most connector shell and the lower-most connector shell to the pair of rails.

According to another aspect of the present disclosure, a stackable modular connector assembly, is provided. The stackable modular connector assembly includes a track having a pair of juxtaposed rails each defining an elongate channel formed therein. Desirably, the channels are oriented toward one another. The stackable modular connector assembly further includes a plurality of connector shells operatively engageable with the track. Desirably, each connector shell extends between the opposed channels of the pair of rails and is slidably stackable within the channels of the track.

Each connector shell may define at least one receptacle and desirably includes a pair of tabs extending from opposed sides thereof. The tabs are selectively slidably engageable in the channels of the pair of rails. It is envisioned that each tab of each connector shell includes a hole formed therein.

Desirably, each rail includes a pair of apertures formed therein. It is envisioned that a first aperture is formed near a first end of the rail and a second aperture is formed near a second end of the rail. Accordingly, the holes from each connector are registerable with the corresponding apertures formed in the pair of rails.

It is envisioned that the track includes a web extending between and interconnecting each rail to one another. In an embodiment the web defines at least one window therein.

Desirably, only an upper-most and a lower-most connector shell are fastened to the pair of rails. It is envisioned that threaded fasteners may be used to secure the upper-most connector shell and the lower-most connector shell to the pair of rails.

For a better understanding of the present invention and to show how it may be carried into effect, reference will now be made by way of example to the accompanying drawings.

DETAILED DESCRIPTION OF THE DRAWINGS

Figure 1:
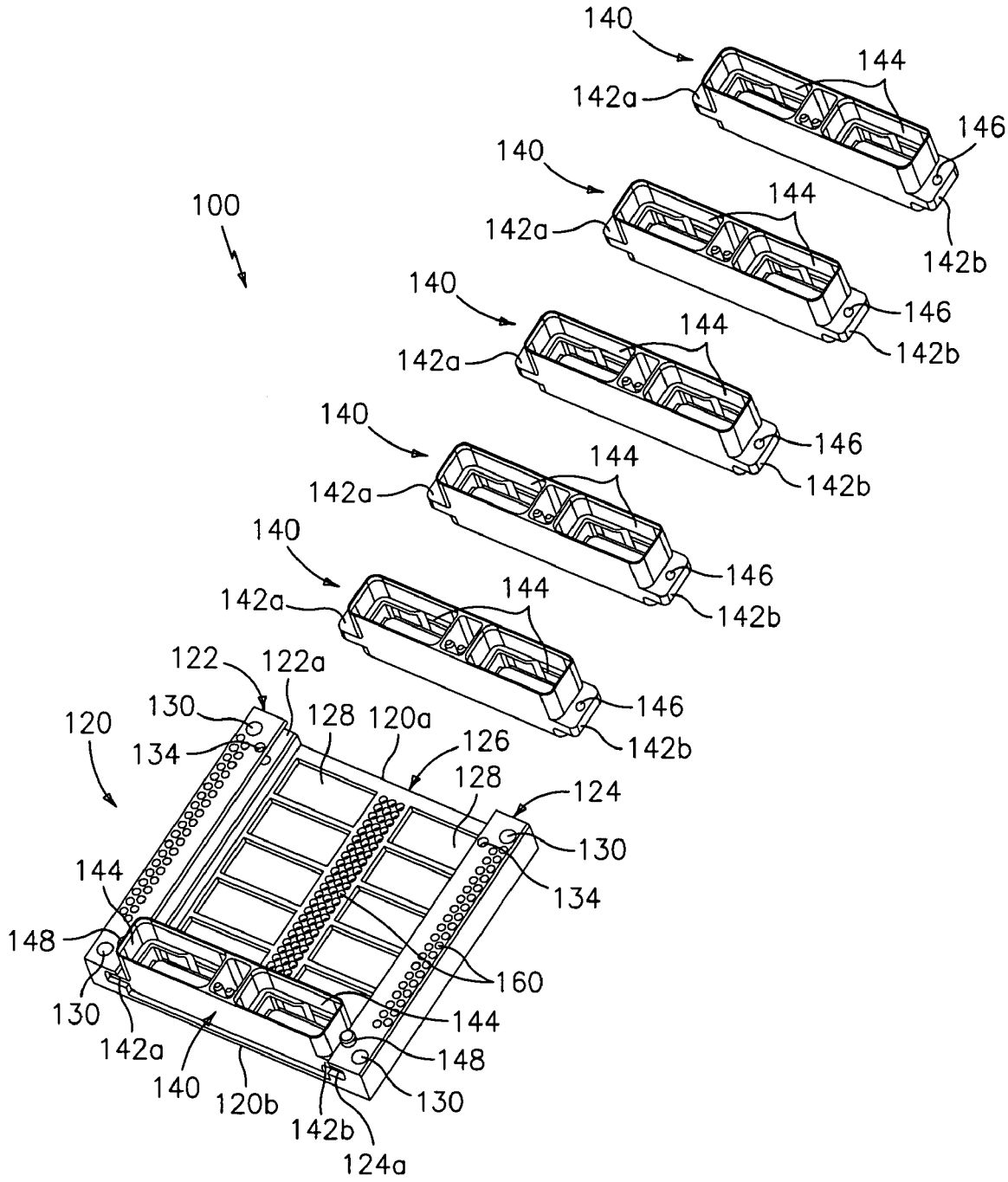
FIG. 1 is a perspective view, with parts separated, of a stackable modular connector assembly according to an embodiment of the present disclosure.
Figure 2:
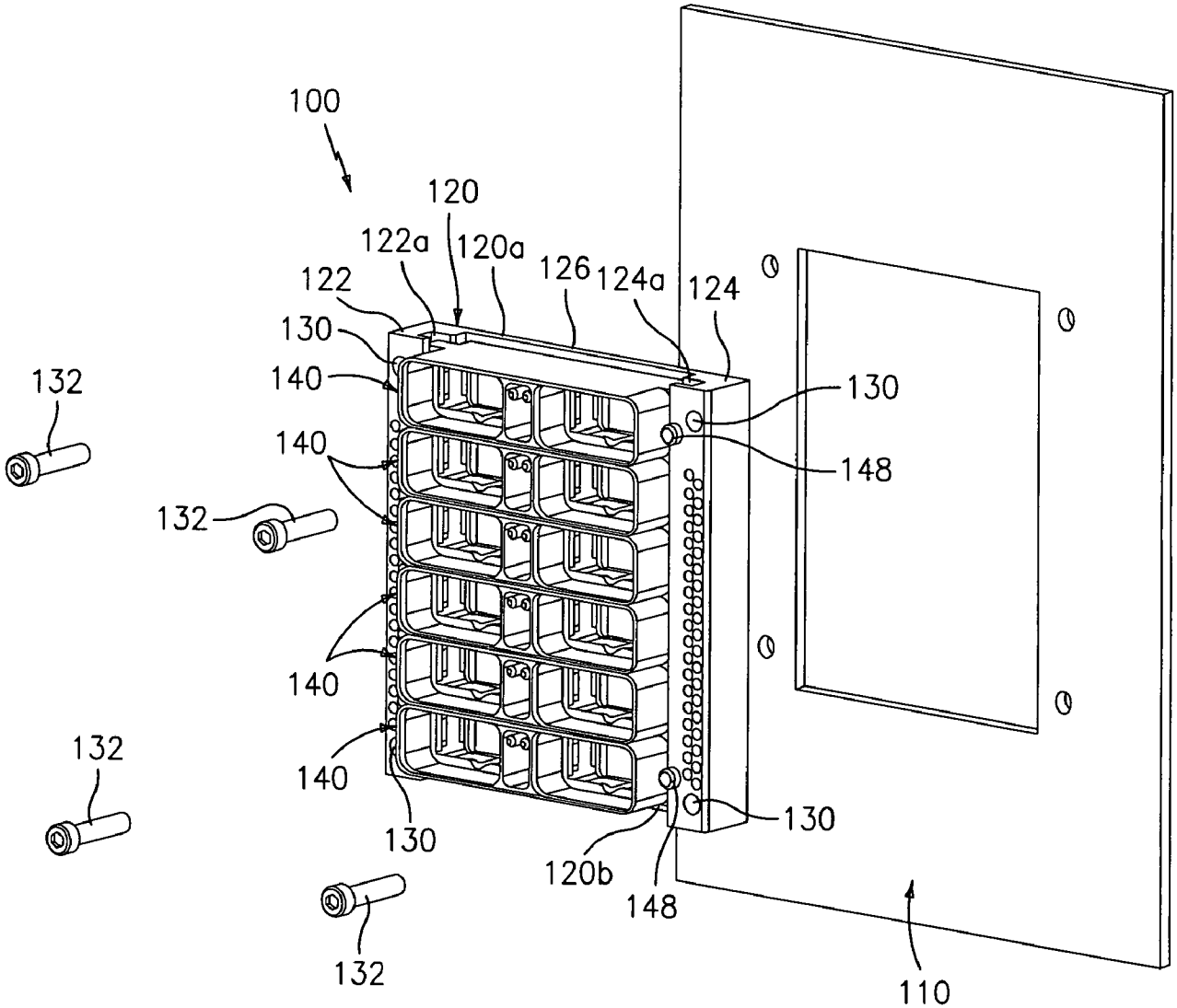
FIG. 2 is a perspective view of the stackable modular connector assembly of FIG. 1, illustrating mounting of the same to a support structure.
Figure 3:
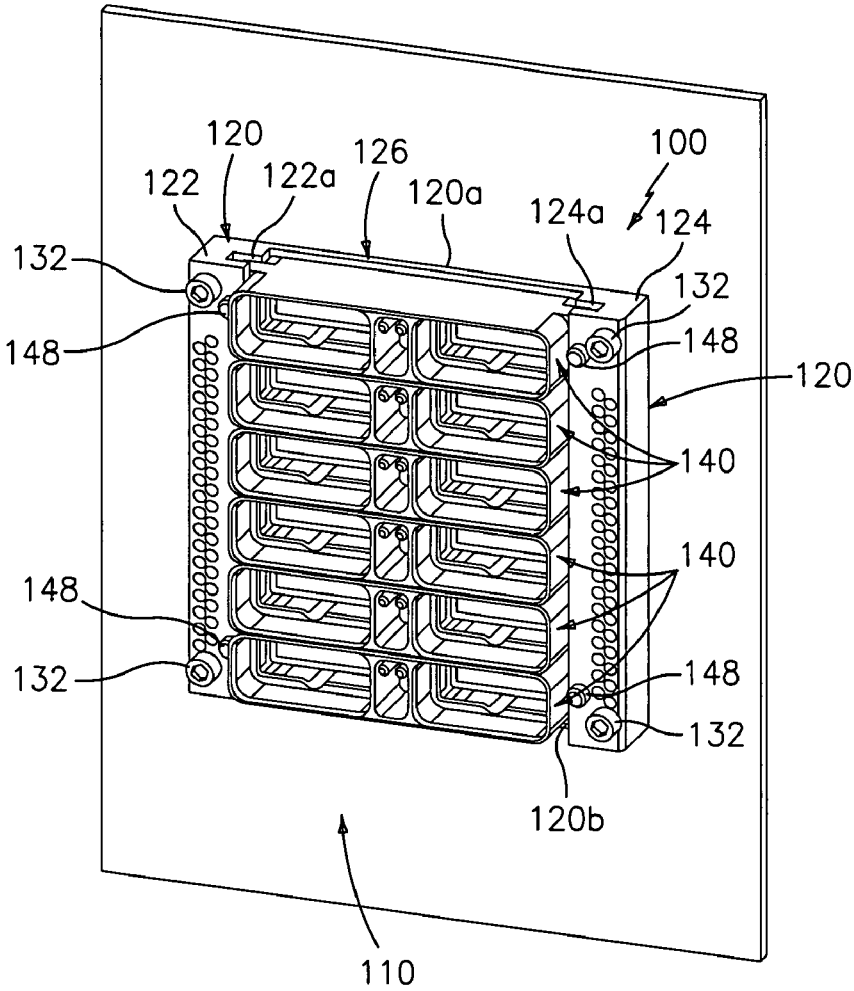
Figure 4:
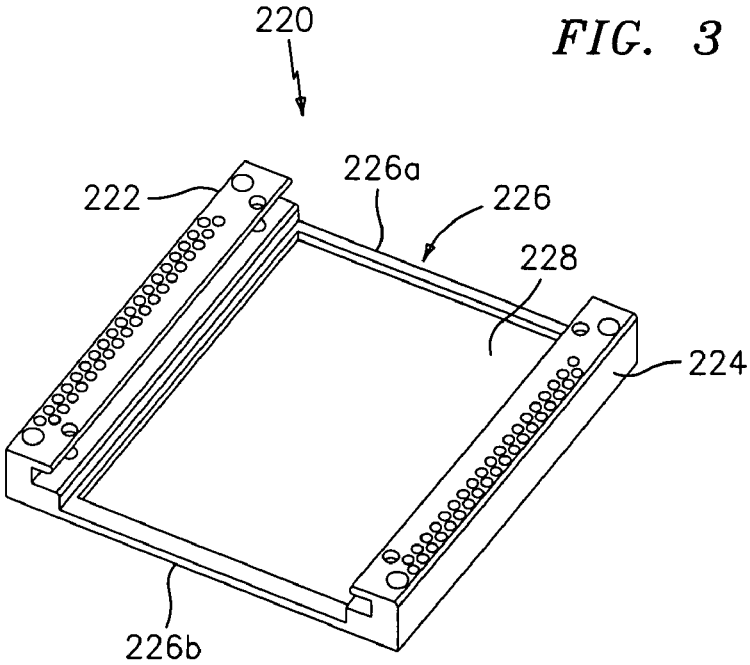
Figure 5:
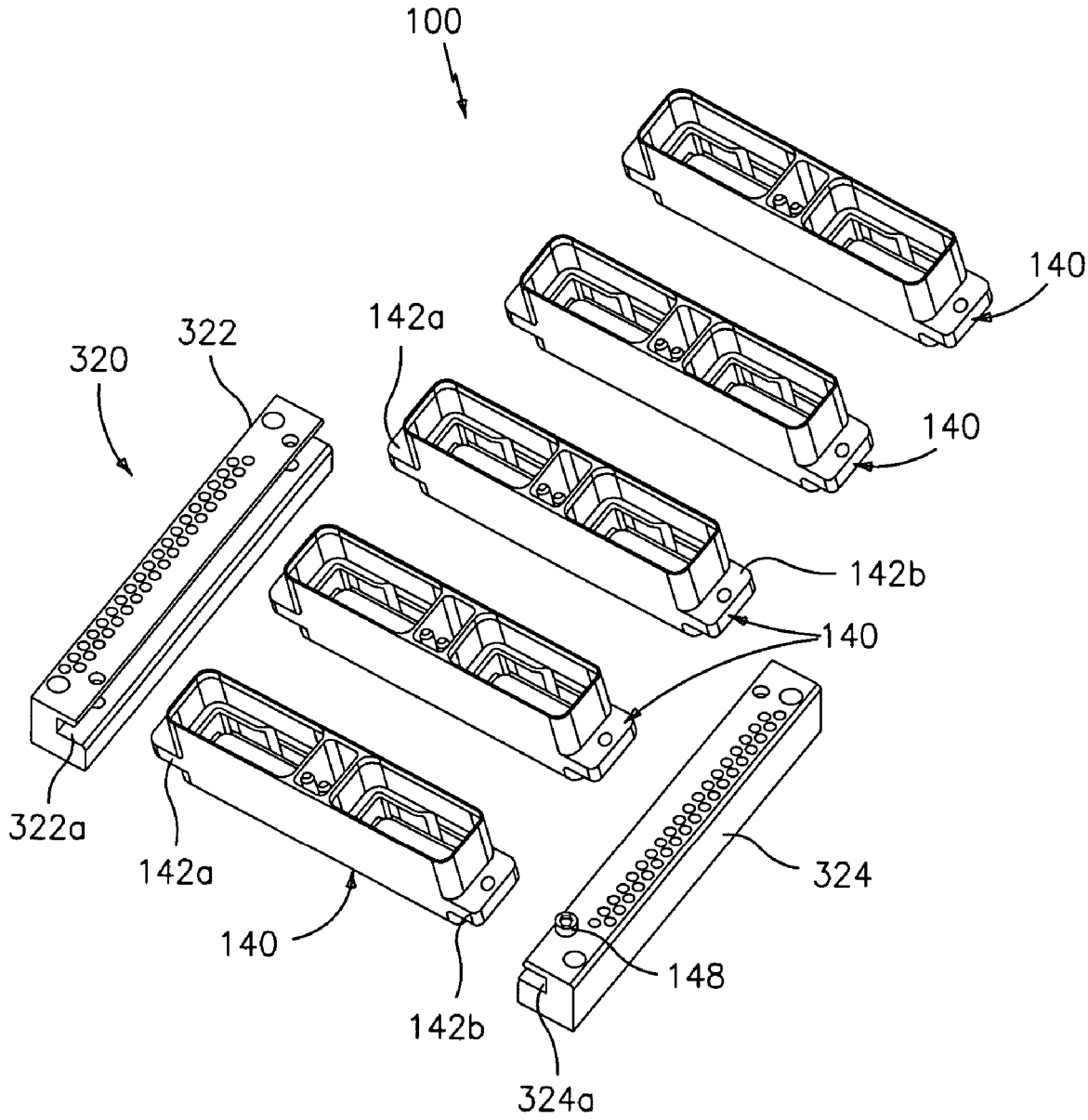

FIG. 3 is a perspective view of the stackable modular connector assembly of FIGS. 1 and 2 mounted to support structure; and FIG. 4 is a perspective view of a housing for a stackable modular connector assembly according to another embodiment of the present disclosure; and FIG. 5 is a perspective view, with parts separated, of a stackable modular connector assembly including a housing or track according to yet another embodiment of the present disclosure.

DETAILED DESCRIPTION OF THE EMBODIMENTS

Embodiments of the presently disclosed stackable modular connector assembly will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1–3, a stackable modular connector assembly, in accordance with an embodiment of the present disclosure, is generally designated as 100. Connector assembly 100 includes a housing or track 120 configured and dimensioned to support at least one, preferably a plurality of, connector shells 140 thereon.

As seen in FIGS. 1–3, housing or track 120 includes a pair of spaced apart rails 122, 124 interconnected by a web 126. Desirably, rails 122, 124 are substantially parallel to one another. Each rail 122, 124 includes a respective longitudinally extending channel 122*a*, 124*a* formed therein. Desirably, channels 122*a*, 124*a* are in juxtaposed relation to one another. Channels 122*a*, 124*a* desirably extend completely through at least one of a top end 120*a* and a bottom end 120*b* of housing or track 120.

Housing or track 120 may be manufactured in specific standard lengths or may be manufactured in a single elongate length which may be cut as needed for a particular application or installation. Desirably, housing or track 120 is made from a substantially rigid plastic material which exhibits some compliancy and resilience.

Housing or track 120 desirably includes a plurality of mounting holes 130 which receive threaded fasteners 132 for attaching and/or mounting housing or track 120 to a support structure 110, such as, for example, a panel 110 as shown in FIGS. 2 and 3. Mounting holes 130 are formed in each rail 122, 124, desirably proximate top end 120*a* and bottom end 120*b* of housing or track 120. Additionally, mounting holes 130 are located orthogonally outward of channels 122*a*, 124*a* (i.e., mounting holes 130 do not extend into channels 122*a*, 124*a*).

As seen in FIG. 1, web 126 of housing or track 120 includes a plurality of apertures or windows 128 formed therein for enabling passage of cabling, connectors and the like (not shown) therethrough. Desirably, web 126 of housing or track 120 includes two columns of windows 128, with each column including six windows 128 total. While an array of twelve windows 128 arranged in a pair of columns is shown and described, it is envisioned and within the scope of the present disclosure for web 126 to include any number of apertures arranged in any number of rows and columns.

With continued reference to FIG. 1, each connector shell 140 includes a pair of tabs 142*a*, 142*b* extending from opposed sides thereof. Desirably, connector shell 140 is configured and dimensioned such that tabs 142*a*, 142*b* slidably engage and/or are slidably receivable in corresponding channels 122*a*, 122*b* of rails 122, 124. Each connector shell 140 further includes at least one, preferably a pair of, receptacles 144 configured and dimensioned to selectively receive and support a connector (not shown) therein.

As seen in FIG. 1, each connector shell 140 includes a hole 146 formed in each tab 142*a*, 142*b* for receiving a threaded fastener 148 for securing connector shell 140 to housing or track 120. Desirably, housing or track 120 includes apertures 134 formed in rails 122, 124 which extend into channels 122*a*, 124*a*. Apertures 134 are configured and dimensioned to receive threaded fasteners 148. Desirably, in use, holes 146 of connector shell 140 register with apertures 134 formed in rails 122, 124 when tabs 142*a*, 142*b* of connector shells 140 are positioned at or near an upper and a lower end of channels 122*a*, 124*a*. In the embodiment shown in FIGS. 1–3, apertures 134 are formed solely near top end 120*a* and near bottom end 120*b* of housing or track 120 and are in registration with an upper row of windows 128 formed in web 126 and a lower row of windows 128 formed in web 126. Alternatively, it is envisioned that apertures 134 may be formed along the entire length of rails 122, 124 for registration with each row of windows 128 formed in web 126.

In use, as seen in FIG. 1, connector shells 140 are slidably connected to housing or track 120 by sliding tabs 142*a*, 142*b* into channels 122*a*, 124*a* of rails 122, 124 either through top end 120*a* or through bottom end 120*b* of housing or track 120. When connector shell 140 is operatively connected to housing or track 120, connector shell 140 is slid along channels 122*a*, 124*a* of rails 122, 124 until receptacles 144 of connector shell 140 are in registration with desired and/or selected windows 128 of web 126. Desirably, a plurality of connector shells 140 are inserted into channels 122*a*, 124*a* of rails 122, 124 so as to completely fill housing or track 120 and overlie each window 128 of web 126.

Desirably, a lower-most connector shell 140 is secured to housing or track 120 with threaded fasteners 148 extending through apertures 134 of rails 122, 124 and tabs 142*a*, 142*b* of connector shell 140. Additional connector shells 140 may then be slidably inserted into channels 122*a*, 124*a* of rails 122, 124 of housing or track 120. Following insertion of an upper-most connector shell 140 into channels 122*a*, 124*a* of rails 122, 124 of housing or track 120, additional threaded fasteners 148 are used to secure the upper-most connector shell 140 to housing or track 120. Desirably, the holes 146 of the lower-most connector shell 140 and the upper-most connector shell 140 are in registration with apertures 134 formed in rails 122, 124.

The lower-most connector shell 140 and the upper-most connector shell 140 function to lock the remaining connector shells 140, disposed between the upper-most and the lower-most connector shell, in place relative to housing or track 120. Desirably, each connector shell 140 may include a slot and/or a dovetail (not shown) formed along a top surface and/or a bottom surface thereof for inter-engagement with a complementary slot and/or dovetail formed in a juxtaposed surface of an adjacent connector shell 140. In this manner, adjacent connector shells 140 may lock with one another when stacked one atop another within housing or track 120.

In accordance with the present disclosure, individual connector shells 140 may be repaired and/or replaced as needed and/or as necessary without having to replace the remainder of the undamaged connector shells 140 and/or without having to replace the supporting housing or track 120. The connector shell 140 in need of repair or replacement is simply slid out of housing or track 120 either from the top end 120*a* or the bottom end 120*b* of housing or track 120.

Turning now to FIG. 4, an alternate embodiment of housing or track 120 of connector assembly 100 is shown generally as 220. Housing or track 220 is similar to housing or track 120 and will only be discussed in detail to the extent necessary to identify differences in construction and operation. Housing or track 220 includes a pair of spaced apart rails 222, 224 interconnected by a web 226. As seen in FIG. 4, web 226 of housing or track 220 includes a single enlarged window 228 formed therein for enabling passage of cabling, connectors and the like (not shown) therethrough.

Desirably, web 226 of housing or track 220 simply includes an upper backspan 226*a* and a lower backspan 226*b* extending between and interconnecting rails 222, 224. Such a construction of housing or track 220 conserves material and reduces cost.

Turning now to FIG. 5, an alternate embodiment of housing or track 120 of connector assembly 100 is shown generally as 320. Housing or track 320 is similar to housing or track 120 and will only be discussed in detail to the extent necessary to identify differences in construction and operation. Housing or track 320 includes a pair of independent spaced apart rails 322, 324.

In use, rails 322, 324 function to secure a plurality of connector shells 140 to one another. In particular, a lower-most connector shell is secured to rails 322, 324 using threaded fasteners 148. The remaining connector shells 140 are positioned such that their respective tabs 142*a*, 142*b* are disposed within channels 322*a*, 324*a* of rails 322, 324. Finally, upper-most connector shell 140 is secured to rails 322, 324 using additional threaded fasteners (not shown).

Essentially, when secured to rails 322, 324, the lower-most and the upper-most connector shells 140 function as the web of housing or track 320.

In accordance with the present disclosure, it is envisioned that the rails (e.g., rails 122, 124, 222, 224, 322 and 324) may be provided with shield terminations and/or grounding in respective channels (e.g., 122*a*, 124*a*) which electrically connect to a hardware panel or the like. Accordingly, it is envisioned that any of the rails disclosed herein may be metallic, composite plastics, or any combination thereof.

It is further envisioned and within the scope of the present disclosure, as seen in FIGS. 1–5, for any of rails and/or the web to be provided with a plurality of relatively small apertures or holes 160 (see FIG. 1) formed therein which optionally enable grounding of housing 120 and/or connector assembly 100 to panel "P" or the like.

It is to be understood that the foregoing description is merely a disclosure of particular embodiments and is no way intended to limit the scope of the invention. Other possible modifications will be apparent to those skilled in the art and all modifications will be apparent to those in the art and all modifications are to be defined by the following claims.

What is claimed is:

1. A stackable modular connector assembly, comprising:

a track including a pair of rails, each rail including a channel formed along a length thereof, the channels of each rail being in juxtaposed relation to one another and defining a plane there between, the plane being substantially parallel to a plane of at least one window provided between the pair of rails; and at least one connector shell supportable by the pair of rails, the at least one connector shell defines at least one receptacle for selectively receiving a connector, each connector shell includes a pair of tabs extending from opposed sides thereof, each tab is configured and dimensioned for being received in an unlocked and slidable engagement in the channels of the rails, wherein a first rail is disposed along a first side of the connector shell and a second rail is disposed along a second side of the connector shell, wherein the at least one receptacle extends from an area below the plane to an area above the plane, is substantially bounded on at least one side thereof by an outer surface of the at least one connector shell, and wherein the at least one receptacle alians with at least a portion of the at least one window, such that an object positioned in a rear side of the connector assembly can be seen via the at least one receptacle and the at least one window from a front side of the connector assembly, the front side being opposite the rear side wherein the each tab of the at least one connector shell includes a hole formed therein;

wherein the each rail includes a pair of apertures formed therein, wherein a first aperture is formed near a first end of the rail and a second aperture is formed near a second end of the rail, wherein the hole from each connector shell is registerable with a corresponding aperture formed in the pair of rails; and wherein the each rail includes at least one mounting hole formed therein for securing the rail to a support structure.

2. The connector assembly according to claim 1, wherein the channel of the each rail extends the entire length thereof.

3. The connector assembly according to claim 2, wherein the track includes a web extending between and interconnecting the each rail to one another.

4. The connector assembly according to claim 3, wherein the web defines the at least one window therein.

5. The connector assembly according to claim 4, wherein the web includes an upper backspan and a lower backspan defining the at least one window therein.

6. The connector assembly according to claim 3, wherein the web defines an aperture for the at least one receptacle of the each connector shell positioned between the pair of rails.

7. The connector assembly according to claim 3, wherein an upper-most and a lower-most connector shell are fastened to the pair of rails.

8. The connector assembly according to claim 7, wherein threaded fasteners secure the upper-most connector shell and the lower-most connector shell to the pair of rails.

9. A stackable modular connector assembly, comprising:

a track including a pair ofjuxtaposed rails each defining an elongate channel formed therein and a plane there between, wherein the channels are oriented toward one another, the plane being substantially parallel to a plane of at least one window provided between the pair of juxtaposed rails; and a plurality of connector shells operatively engageable with the track, wherein each connector shell extends between opposed channels of the pair of rails and is slidably stackable within the channels of the track, the each connector shell defining a receptacle extending from an area below the plane to an area above the plane and being substantially bounded on at least one side thereof by an outer surface of the each connector shell, and wherein the at least one receptacle aligns with at least a portion of the at least one window, such that an object positioned in a rear side of the connector assembly can be seen via the at least one receptacle and the at least one window from a front side of the connector assembly, the front side being opposite the rear side wherein the each connector shell defines the receptacle and includes a pair of tabs extending from opposed sides thereof, wherein the tabs are selectively slidably engageable in the channels of the pair of rails;

wherein the each tab of the at least one connector shell includes a hole formed therein;

wherein the each rail includes a pair of apertures formed therein, wherein a first aperture is formed near a first end of the rail and a second aperture is formed near a second end of the rail, wherein the hole from each connector shell is registerable with a corresponding aperture formed in the pair of rails; and wherein the each rail includes at least one mounting hole formed therein for securing the rail to a support structure.

10. The connector assembly according to claim 9, wherein the track includes a web extending between and interconnecting the each rail to one another.

11. The connector assembly according to claim 10, wherein the web defines the at least one window therein.

12. The connector assembly according to claim 11, wherein an upper-most and a lower-most connector shell are fastened to the pair of rails.

13. The connector assembly according to claim 12, wherein threaded fasteners secure the upper-most connector shell and the lower-most connector shell to the pair of rails.

* * * * *